United States Patent [19]

Meyers et al.

[11] 4,287,704

[45] Sep. 8, 1981

[54] FOLDING AND GLUING MACHINE

[75] Inventors: George L. Meyers, Ashland, Ohio; Frederick C. Seiden, Holmes Beach; Lonnie J. Waller, Sarasota, both of Fla.

[73] Assignees: American Can Company, Greenwich, Conn.; Rexham Corp., Sarasota, Fla.

[21] Appl. No.: 104,178

[22] Filed: Dec. 17, 1979

Related U.S. Application Data

[62] Division of Ser. No. 954,402, Oct. 25, 1978, Pat. No. 4,210,069.

[51] Int. Cl.[3] ..... B65B 5/02

[52] U.S. Cl. ..... 53/564; 198/377; 493/125; 493/131; 493/179

[58] Field of Search ..... 53/566, 564, 452, 456, 53/458, 558; 93/53 SD, 53 R, 49 R, 36 R, 36 M, 45; 198/377, 404, 379; 493/179, 178, 182, 180, 122-126, 147, 131, 130

[56] References Cited

U.S. PATENT DOCUMENTS

| | | | |
|---|---|---|---|
| 3,097,733 | 7/1963 | Frydryk | 198/377 |
| 3,280,531 | 10/1966 | Meyer-Jagenberg | 53/456 X |
| 3,656,417 | 4/1972 | Scully | 93/53 R X |
| 3,760,554 | 9/1973 | Arneson | 53/564 X |
| 3,978,773 | 9/1976 | Pinto | 93/49 R X |

*Primary Examiner*—James F. Coan

*Attorney, Agent, or Firm*—Robert P. Auber; George P. Ziehmer; Ira S. Dorman

[57] ABSTRACT

A carton blank may be folded by folder blades supported on an adjustable plate positioned on one side of a chain which carries a clamp by which the carton blank is pulled through the machine. After folding, the blank is glued to complete a flat shell and the shell is then inverted; the clamp is articulated so the shell may be turned in a horizontal plane to align a datum line on the shell to a datum line on a cartoner machine.

19 Claims, 21 Drawing Figures

FOLDING AND GLUING MACHINE

This is a division of application Ser. No. 954,402, filed Oct. 25, 1978, now U.S. Pat. No. 4,210,069.

The present invention relates to a folding and gluing machine which forms a carton from a flat blank into a side seam glued shell, capable of loading the glued shell directly into the magazine of a cartoning machine which herein will be referred to as the "cartoner".

One object of the present invention is to so construct the folding and gluing machine that it may be positioned above the cartoner to become a part thereof in the sense that glued carton shells may be fed directly into the supply magazine of the cartoner with an edge or line of the glued shell oriented to a datum line of the cartoner. This is of advantage because the shells may be formed from a flat blank, glued, pre-broken and delivered directly to the cartoner without interim storage. This means the shell will retain the springiness inherent in the score lines immediately after folding and pre-breaking which in turn assures prompt, square erection of the carton as it leaves the magazine of the cartoner for the filling sequence. In comparison, storage of the folded and glued shell over a prolonged period can, because of humidity, stack weight and aging, cause the shell to become indisposed to proper draw-down in the cartoner. In referring to breaking the shell we mean of course the standard practice of flexing the shell after it is folded and glued to break the score lines so the carton may be easily erected in the course of delivery from the supply magazine of the cartoner.

A related object of the present invention is to save warehouse storage space, to save the cost of constant rotation of carton inventory and to avoid inventorying shells on a first-in, first-out basis heretofore necessary because of prolonged storage.

Under the present invention, space around the cartoner is conserved by folding and gluing the carton blank along a feed path which is parallel to the filling path of the cartoner. Specifically, the folding and gluing path is directly above the cartoner so that the glued shells may in effect be dropped into the supply magazine of the cartoner, rather than lateral or side feeding and so to do constitutes another object of the present invention. By inverting the glued shell and then turning it in a horizontal plane, a datum line on the glued shell may be oriented to a datum line of the cartoner for directly loading the supply magazine of the cartoner and the accomplishment of this represents another object of the present invention, that is, the glued shell may be inverted and turned so that it will be squared to the supply magazine of the cartoner.

The supply magazine of most cartoners is so constructed that as the flat shells are fed therefrom they are, at the same time, erected and opened for filling. Erection of the carton is much easier, and squaring is assured, if it is "pre-broken" along the erecting score lines. Another object of the present invention is to so construct the present machine that the glued shells are pre-broken prior to and as an incident to delivery to the supply magazine of the cartoner. A related object of the present invention is to fold and glue the cartons at a rate faster than the rate at which the erected cartons move through the cartoner thereby enabling the supply magazine of the cartoner to be filled on a "demand" basis. Thus this feature of the present invention is to be distinguished from previous folding and gluing machines synchronized to the rate of the cartoner.

Other objects of the present invention are to enable different sizes or styles of carton blanks to be easily handled, to pull rather than push the carton blanks through the various stations which, incidentally, enables the glued shell to be uniquely and effectively turned for datum line orientation, to avoid the need for folding and erecting around a mandrel, to pre-erect or pre-break the glued shells in a unique way so that the pre-break is a consequent feature of uninventoried direct delivery to the cartoner, to construct the machine so that a maximum number of operations may be accomplished in minimum space, to assure the carton blanks are easily and effectively extracted one-by-one from a magazine containing the blanks to be folded and glued, and to capture the blanks in an articulated spring biased clamp which tows or pulls the carton while enabling the glued shell to be turned for datum line orientation.

In summary, the present folding and gluing machine greatly enlarges the capability of the cartoner machine and is itself thoroughly flexible in the sense of accommodating different carton sizes by quick, easily accomplished changes. Most of the advantages relate to the proposition of being able to fold and glue on an axis parallel to and preferably above that of the cartoner, followed by inverting and turning the shell so it will be oriented to a datum line of the cartoner. Nonetheless, these features would allow the shell to be fed laterally to the cartoner magazine rather than vertically downward, although, as noted, vertical feeding is preferred because of the savings in space.

Also, the shell may be fed to the cartoner with the glue flap facing either up or down. In understanding what we say next, it should be remembered that the shell is inverted after being glued and before delivery to the cartoner as one feature of the present invention. Now then, to explain further, the preference is that the shell be fed to the cartoner with the glue flap down (that is, at the back side of the filled carton setting on the store shelf as it should be for aesthetics) because that allows the front face (the "selling face") of the carton to be easily printed or labelled top-side in the cartoner with some special selling feature not appearing on the printed or decorated carton blank as purchased. However, if there is some production reason demanding that the glue flap face downwards during the folding and gluing stage (meaning the glue glap will be uppermost as the carton goes through the cartoner) then any special printing or labeling may be done ahead of the cartoner, in the present machine that is.

IN THE DRAWING

GENERAL DESCRIPTION

Figures 10, 11, 12, 13:
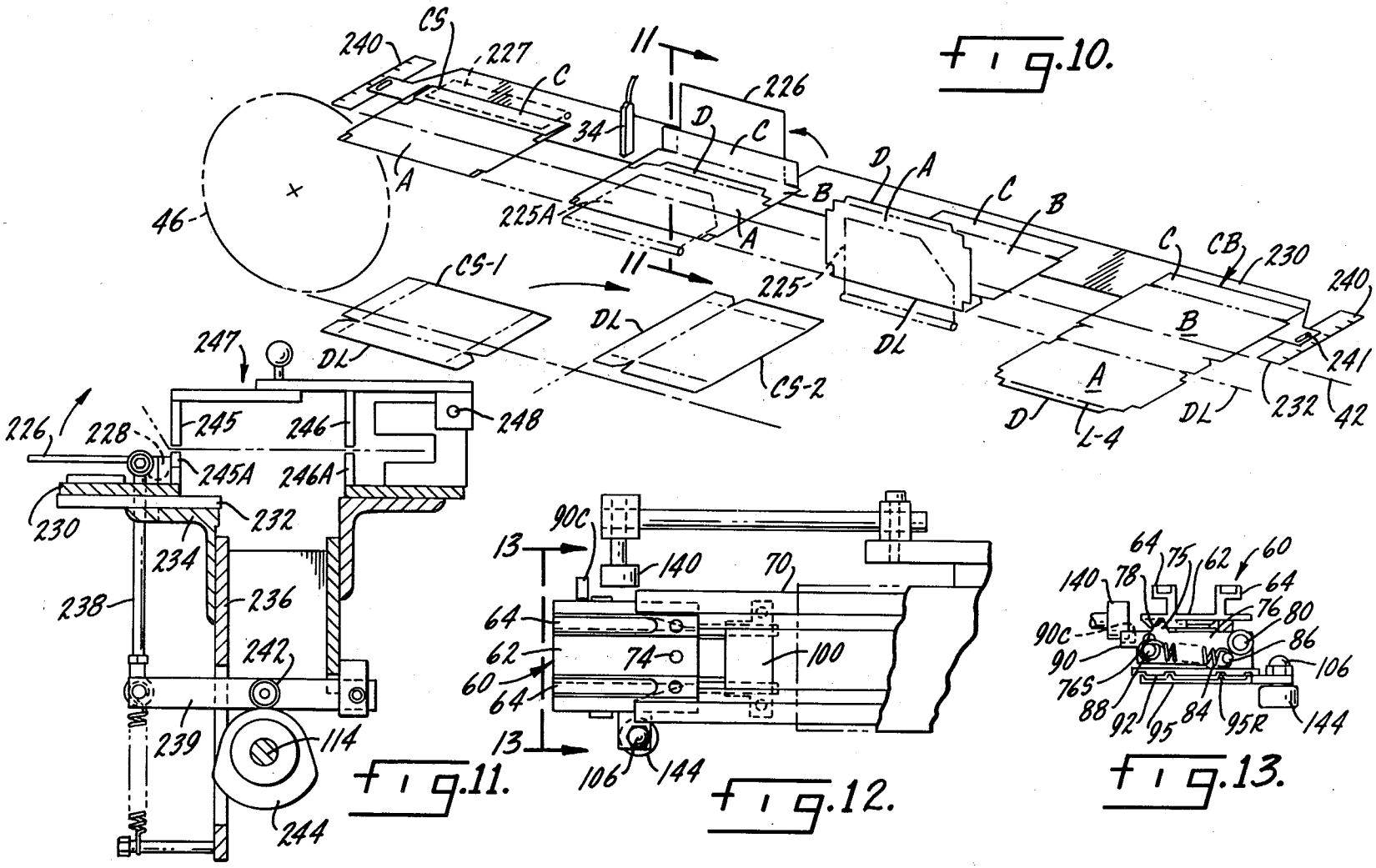
FIG. 10 is a schematic view showing stages of folding, gluing, inverting and turning the carton blank and shell made therefrom.
FIG. 11 is a detail sectional view taken substantially on the line 11—11 of FIG. 10.
FIG. 12 is a detail plan view, fragmented, showing the position of the clamp after being inverted and in position to be turned.
FIG. 13 is an end view on the line 13—13 of FIG. 12.
Figure 21:
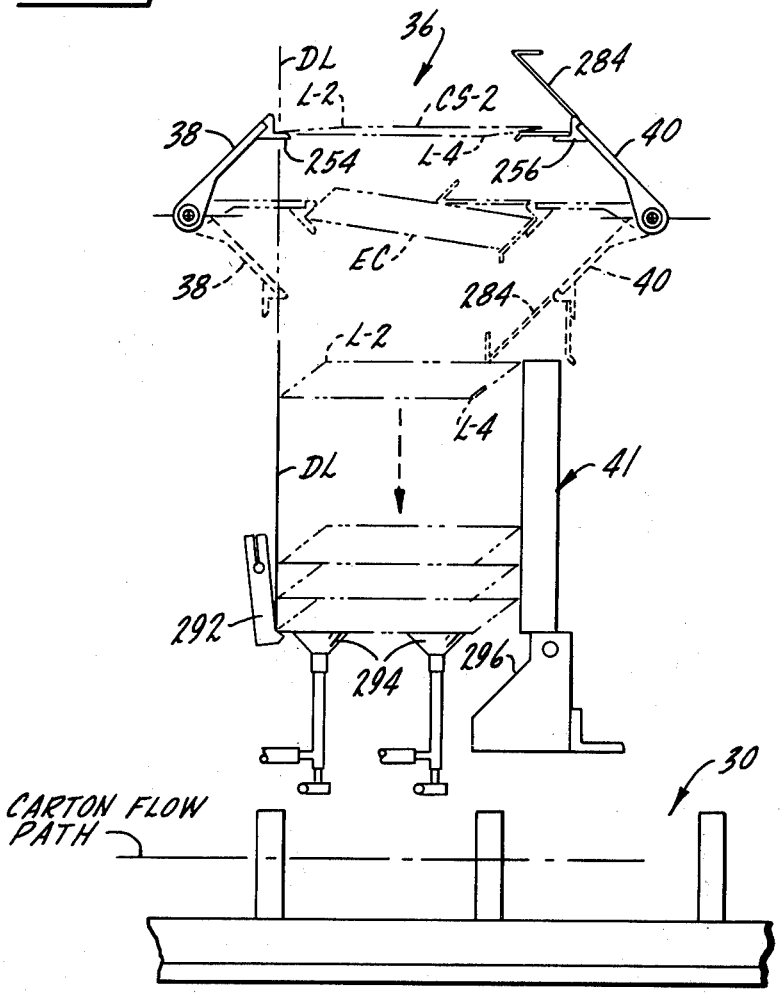
FIG. 21 is a partly schematic view looking in the same direction as FIG. 17 but showing the position of the cartoner.

A flat carton blank CB, FIG. 10, is to be folded and glued progressively and eventually delivered to the receiving magazine of a cartoner machine 30, FIG. 21.

Figure 1:
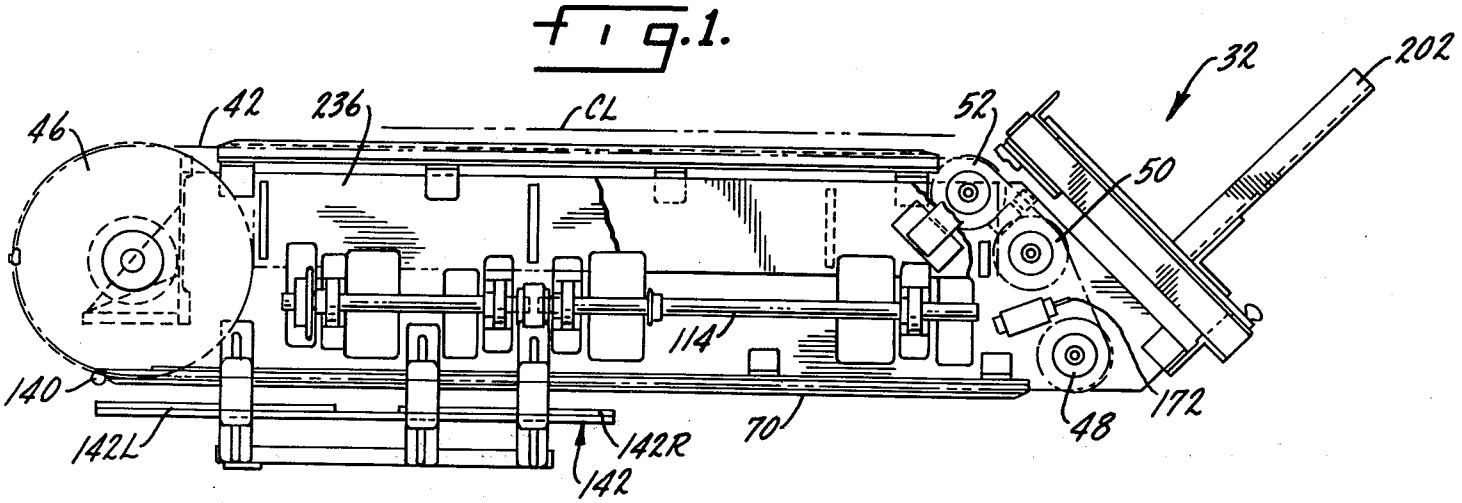
FIG. 1 is a side elevation of a machine constructed in accordance with the present invention.

The blank shown in FIG. 10 was extracted from a carton blank supply magazine 32, FIG 1, located at what may be termed a supply or loading station. The blank is extracted by suction cups and then is captured by a clamp on an endless chain as will be described.

Folding and gluing takes place along a plane CL, FIG. 1, which is parallel to and above the filling path of the cartoner machine.

After the carton is folded, a hot melt glue is applied by a glue nozzle 34, FIG. 10. The flat, glued shell CS is then inverted about a sprocket and turned through a predetermined angle in a horizontal plane.

Figure 17:
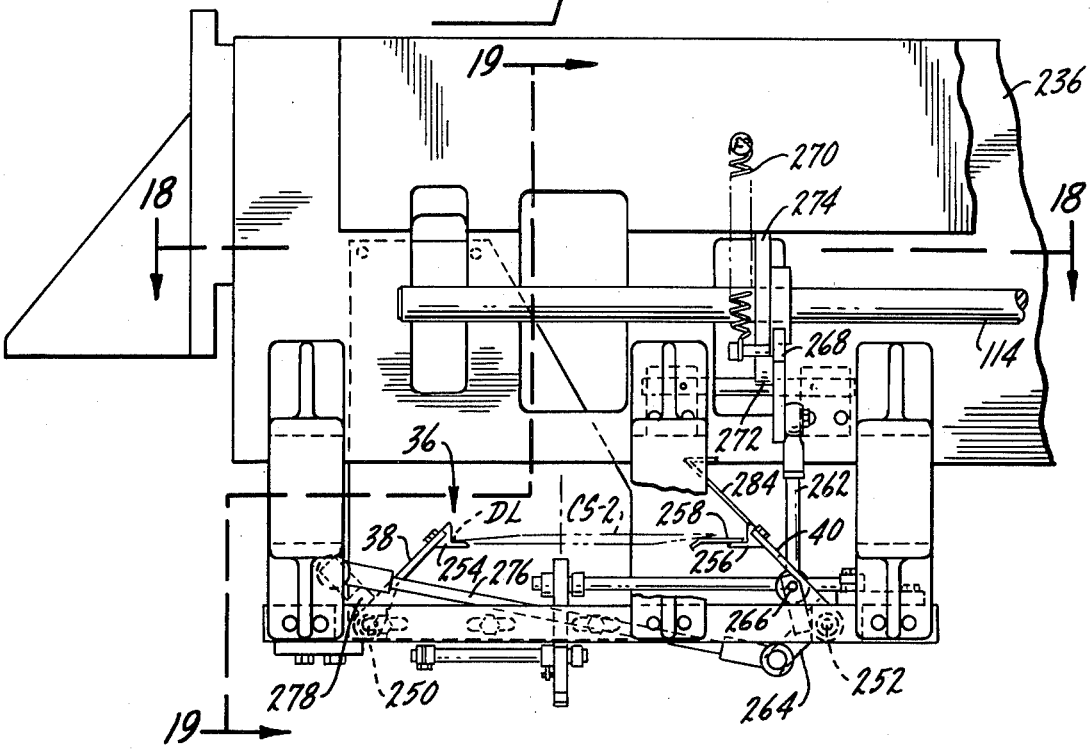
FIG. 17 is an elevation view at the unloader or pre-breaker station.
Figure 18:
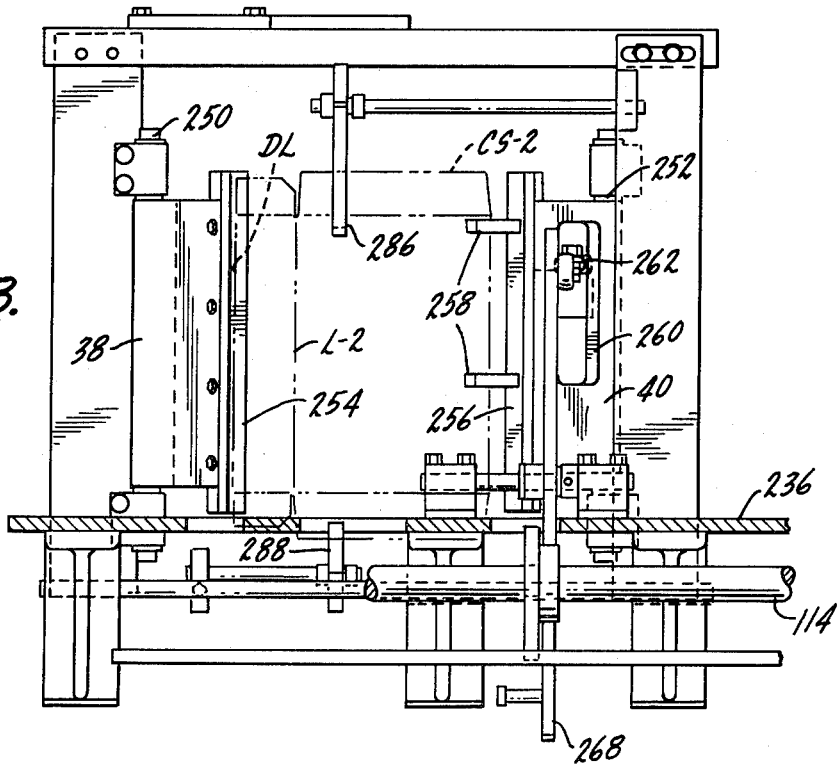
FIG. 18 is a plan view on the line 18—18 of FIG. 17.
Figure 19:
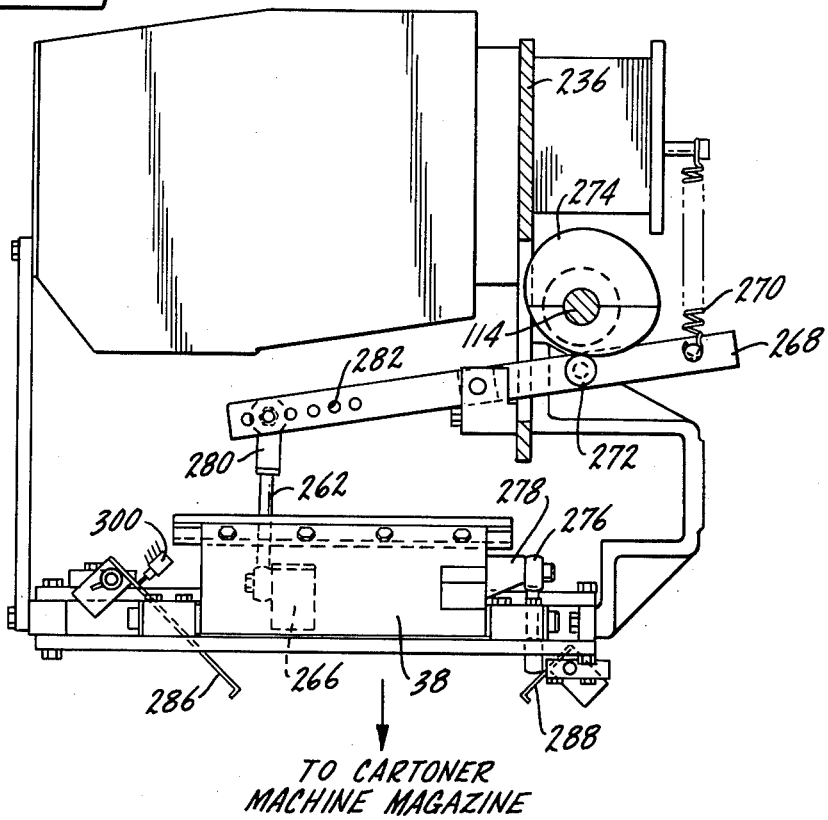
FIG. 19 is an elevational view, partly in section, on line 19—19 of FIG. 17.

After the flat, glued shell has been turned, the clamp is opened to release the shell and deposit it in an unloading or pre-breaker station, FIGS. 17 and 18, where a pre-breaker cradle 36, in the form of a pair of pivotal arms 38 and 40, are effective to squeeze the shell to erect it and then deliver the shell to the receiving or supply magazine 41 of the cartoner (see also FIGS. 19 and 21).

Figure 2:
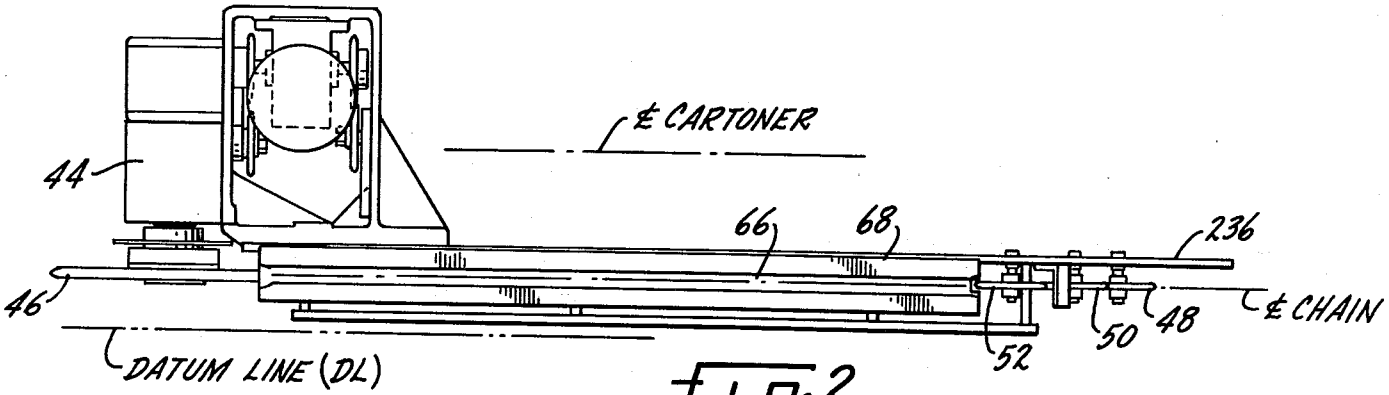
FIG. 2 is a partial top plan view of the machine shown in FIG. 1.

The chain is shown by dashed line 42 in FIG. 1. It is driven intermittently by an indexing drive motor 44 (FIG. 2) having a shaft keyed to the hub of a large drive sprocket 46 at the left end of the machine as viewed in FIG. 1. The sprocket 46 of course reverses the chain at the left end of the machine.

Three idler sprockets 48, 50 and 52 at the right hand end of the machine re-reverse the chain.

The chain is thus driven independently of the cartoner machine, which is of advantage as will be explained. In fact, the indexing drive for the chain is controlled and timed so that the chain has the following stop or intermittent positions:

(1) adjacent sprocket 52 at the supply magazine to pick up a carton blank;

(2-3) at two different folding stations along the upper pass of the chain;

(4) at a folding and compressing station where the glued flap is compressed;

(5) part way around sprocket 46;

(6) at the bottom of sprocket 46;

(7) at the station shown in FIG. 10 where the shell has been turned incidental to releasing it to the pre-breaker apparatus 36;

(8-9) two intermediate positions along the lower pass or run downstream of position (7); and

(10) at idler sprocket 48, one step from sprocket 52.

Useful work is accomplished at positions (1), (2), (3), (4) and (7). Glue is applied "on the fly" while the carton blank is moving into the glue flap compressing station. At positions (5) and (6) the carton is only being inverted and at positions (8), (9) and (10) the clamp on the chain carries no carton at all but is only in transit back to the supply magazine 32.

THE CLAMP

The clamp is constructed so it may be attached to the chain, opened against a return spring action to receive and grab a carton blank at the supply magazine and afterwards opened to release the glued shell. Also, the clamp is articulated, having a back or support member attached to the chain and a pivotal head enabling the glued shell to be turned.

Figure 8:
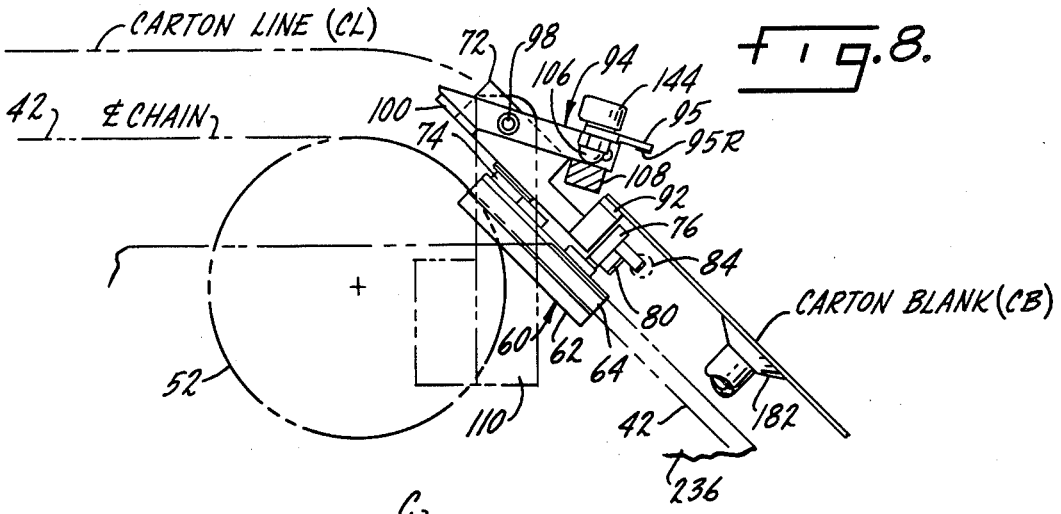
FIG. 8 is a detail view at the right hand end of the machine as viewed in FIG. 1 and showing the manner in which the clamp is opened.

Referring to FIG. 8, the clamp is identified at 60. It has a rigid back 62 fastened to chain 42. The back has a pair of parallel, opposed, U-shaped guide flanges 64 (see also FIG. 13 where the clamp is inverted compared to FIG. 8) which will ride in a track 66 presented by a flanged guide bar 68 at the top of the machine and a similar guide bar 70 at the bottom, FIGS. 1 and 2.

Again referring to FIG. 8, the clamp 60 has a head 72 swingably mounted on a fixed post 74 projecting from the back member. The swinging head normally is latched in place by a protuberance 75, FIG. 13, on a latch finger 76, the protuberance fitting a notch 78 presented by the clamp back 62.

The latch finger is pivoted on the clamp head by a pin 80, FIG. 13. The latch is held locked by a spring 84 anchored at one end on a pin 86 fixed to the latch finger at a point displaced form the pivot, and anchored at the opposite end to a pin 88 carried by the clamp head. The pin 88 projects through an enlarged slot 76S in the latch finger permissive of latch finger pivotal movement.

Spring 84, as noted, holds the latch closed. The latch may be opened by a force applied to the sloped surface of a projection 90 at the end of the latch finger opposite the pivot pin 80. When the latch is released, the clamp head may be turned independently of the clamp back which is always fast on the chain.

Referring to FIG. 8, the clamp head has a fixed jaw or anvil 92 and a movable jaw 94. The movable jaw 94 carries a fixed lip 95 having several serrated ribs 95R fitting small notches in the lower fixed jaw 92 securely to clamp the carton blank.

Figure 9:
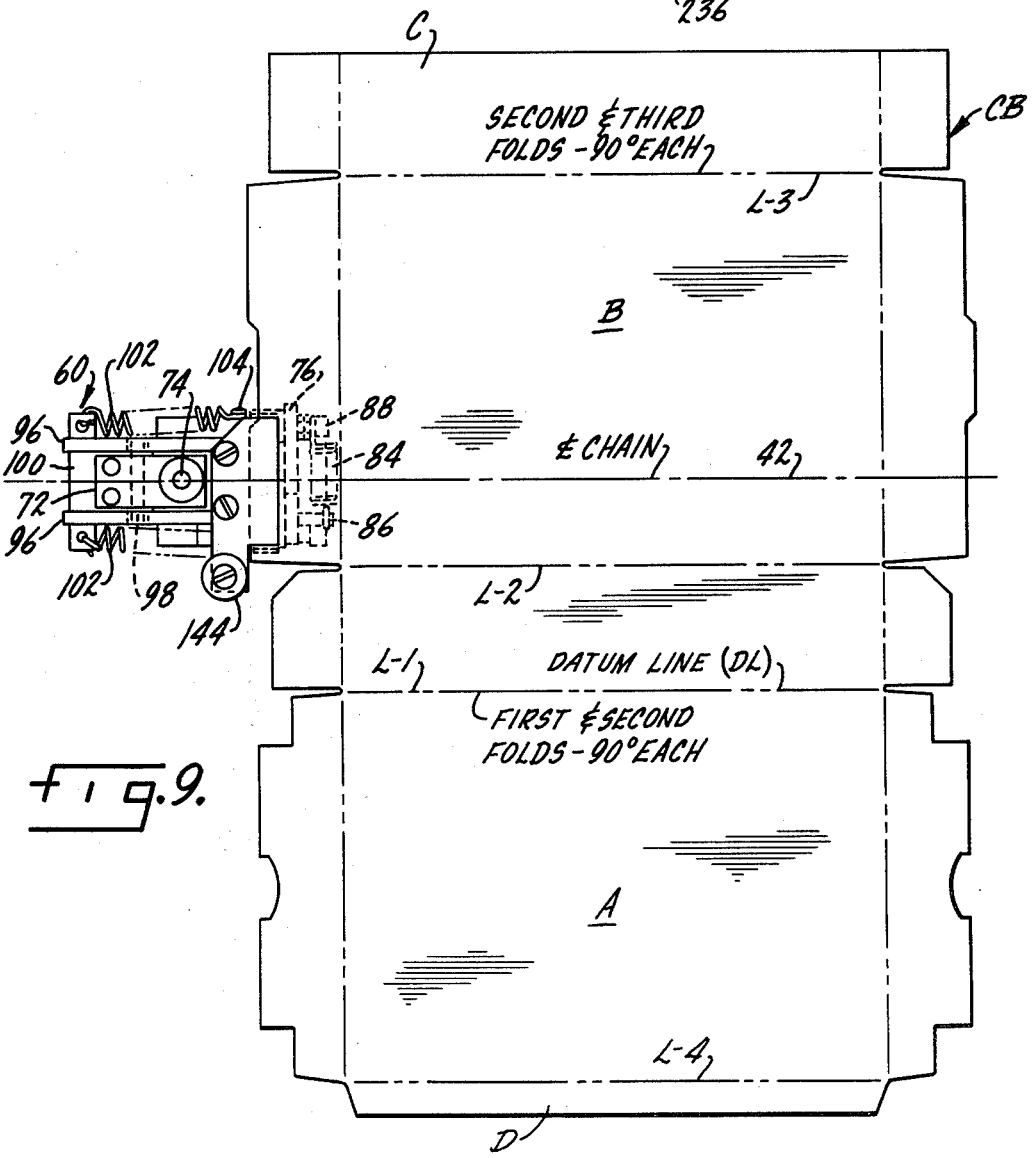
FIG. 9 is a plan view of a typical carton blank and the clamp in which it is secured.

The movable jaw has a pair of fingers 96, FIG. 9, extending rearward therefrom. These fingers are pivoted on a pin 98 carried by the clamp head. An anchor plate 100 is secured to the underside of the clamp head and in order normally to hold the movable jaw closed on the fixed jaw a pair of springs 102 are anchored at one end on plate 100 and at the opposite end are anchored to a pin as 104 mounted on each jaw finger 96.

The movable or upper jaw is shown open in FIG. 8, in order that the clamp jaws may receive and capture the carton blank shown in dashed line in FIG. 9. The jaws were opened relative to one another by an upward force applied to the underside of the upper jaw as viewed in FIG. 8.

The jaw opening force is applied to an acorn nut 106 supported on the upper jaw. The opening force is exerted by a lug 108 on an arm 109 pivotally mounted on an upright support 110 and is turn operated by a rod 112, FIG. 3.

Figure 3:
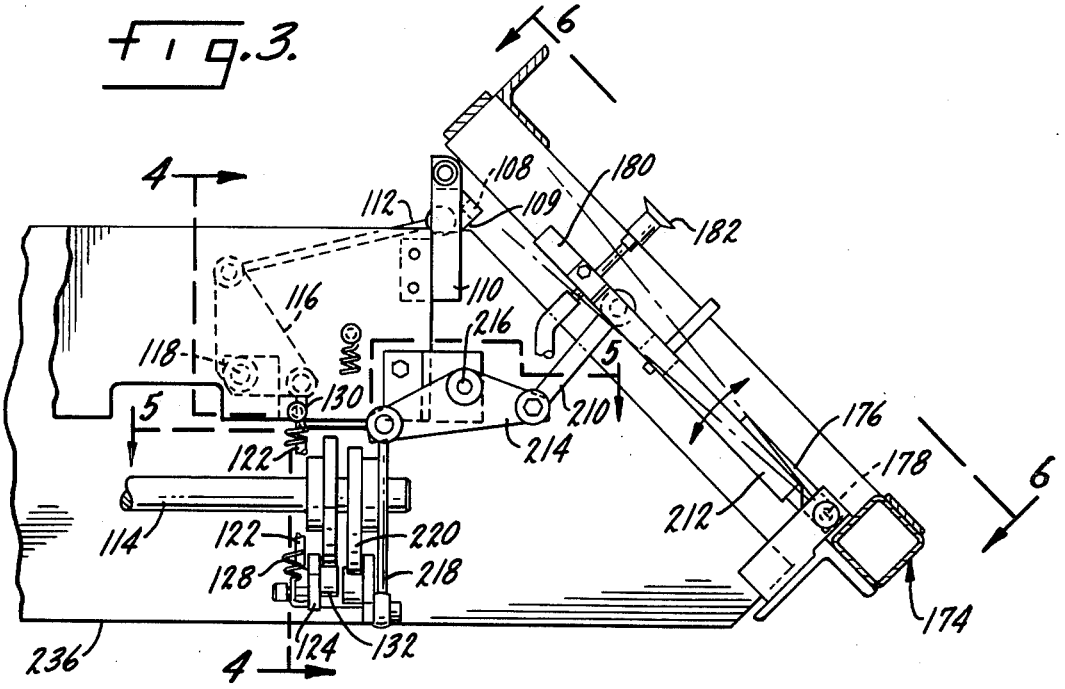
FIG. 3 is a fragmentary side elevation at the right hand end of the machine as viewed in FIG. 1, on an enlarged scale.

The machine has a long cam shaft 114, FIG. 3 which carried the various cams employed for originating and timing many motions. One such timed motion is that of the clamp opener rod 112.

Thus, rod 112 at the end opposite the related jaw opener lug 108 is attached to a bell crank lever 116, FIG. 3, pivotally supported at 118 in the machine.

Figure 4:
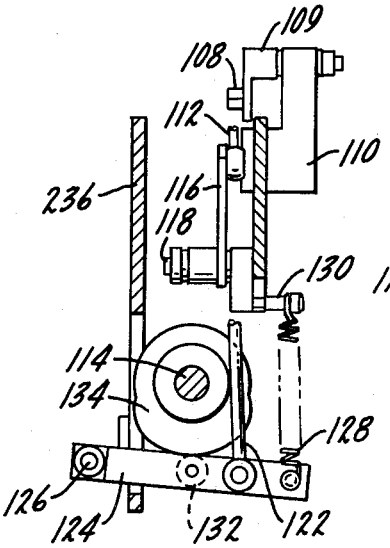
FIG. 4 is a fragmentary sectional view on the line 4—4 of FIG. 3.

The bell crank is controlled by a rod 122 attached at its upper end to the bell crank at a point displaced from the pivot 118. Rod 122 at the lower end is secured to a lever 124, FIG. 4, pivoted at 126.

Arm 124 opposite its pivot 126 has one end of a return spring 128 attached thereto and the upper end of this spring is secured to a fixed pin 130. Spring 128 is effective to hold a cam follower 132 on arm 124 against a cam 134 which rotates with the cam shaft 114.

The rise of cam 134 is timed to the arrival of the closed clamp approaching the leading edge of a carton blank extracted from the supply magazine. The carton blank is extracted by suction fingers and is presented to the clamp as will be explained below, and as this occurs the rise or lobe of cam 134 presses lever 124 downward against the return action of spring 128 which in turn pulls rod 122 downward, FIGS. 3 and 4, pivoting bell crank 116 to operate rod 112 to cause the upper jaw of the clamp to be opened.

When the dwell of cam 134 is presented to the follower 132 reverse movement of the bell crank 116 occurs and the clamp is closed by its springs 102 to clamp the leading edge of the carton blank. The carton blank is thus captured by the clamp while the chain 42 is stationary and the chain drive is indexed so that the carton blank is carried to the first folding station.

However, before considering in detail the manner in which the blank carton is extracted from the supply magazine and the manner in which the blank is subsequently folded and glued, it is deemed appropriate at this stage of the disclosure to consider further details of the clamp structure and in particular the manner in which the clamp latch finger is released to allow the clamp head to be turned and also the manner in which the clamp is opened during the lower path of the chain to release the shell which was previously folded and glued.

Again, in the detailed description to follow, it must be remembered that when the chain turns downward around sprocket 46 at the left end of the machine the clamp is being inverted. Consequently, the clamp base 62 which is lowermost in FIG. 8 is uppermost as viewed in FIG. 12, which is a view at the underside of the chain in its lower path. It was also mentioned the clamp has guide flanges 64 related to a lower guide bar 70, FIG. 1, which is to say that the parts shown in FIG. 12 are being looked at from the underside of the guide bar 70 shown in FIG. 1.

To open or release the latch finger thereby to allow the head of the clamp to be turned relative to the clamp base, the machine is provided with a roller 140, FIG. 12, supported in a fixed position at the bottom of sprocket 46. The position of this roller is shown in FIG. 1. Roller 140 is so positioned at to lie in the path of a sloped camming surface 90C presented by the projection 90, FIG. 12. The clamp shown in FIG. 12 would be moving from left to right and as the sloped cam surface 90C strikes roller 140, the latch finger 76 is actuated to displace protuberance 75 from notch 78, FIG. 13. Consequently the clamp head has been released from the clamp base and therefore may be turned to turn the folded, glued carton shell in a horizontal path for reasons to be explained.

It has also been mentioned that after the shell is turned in the manner just mentioned it is to be released and dropped at a pre-break station. This requires that the clamp jaws be opened and this is accomplished by another camming action. The way in which the clamp head is turned after the latch is released and the manner in which the jaws are opened after the clamp has attained the pre-break station will now be described.

Figure 14:
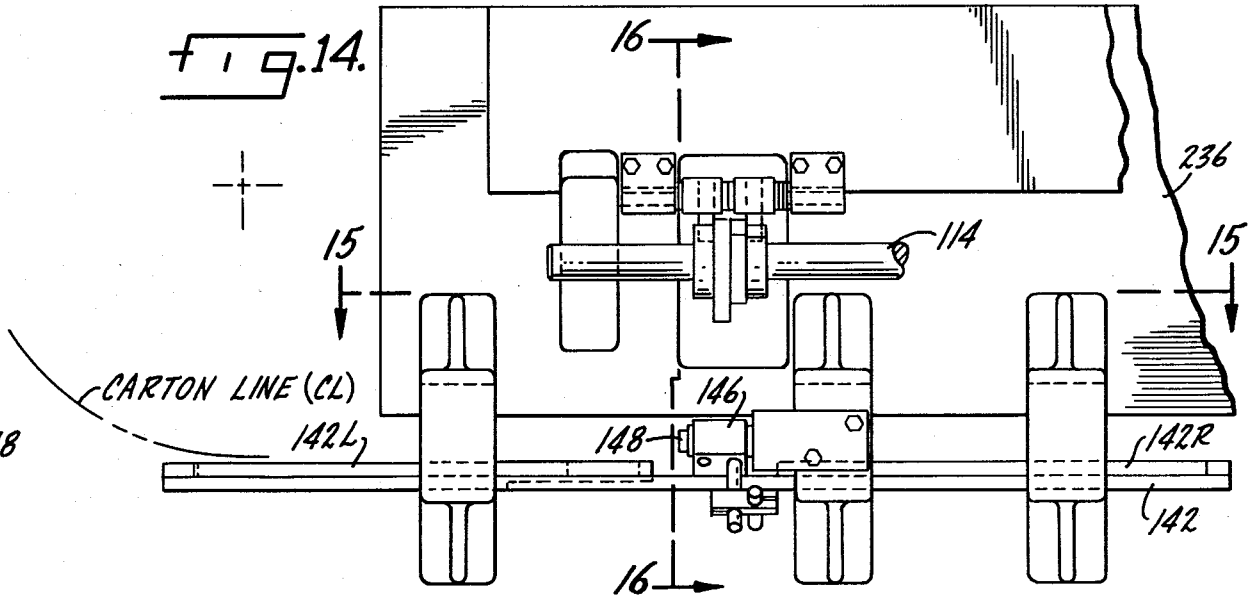
FIG. 14 is a detail elevation, on an enlarged scale, at the lower left end of the machine shown in FIG. 1.
Figure 15:
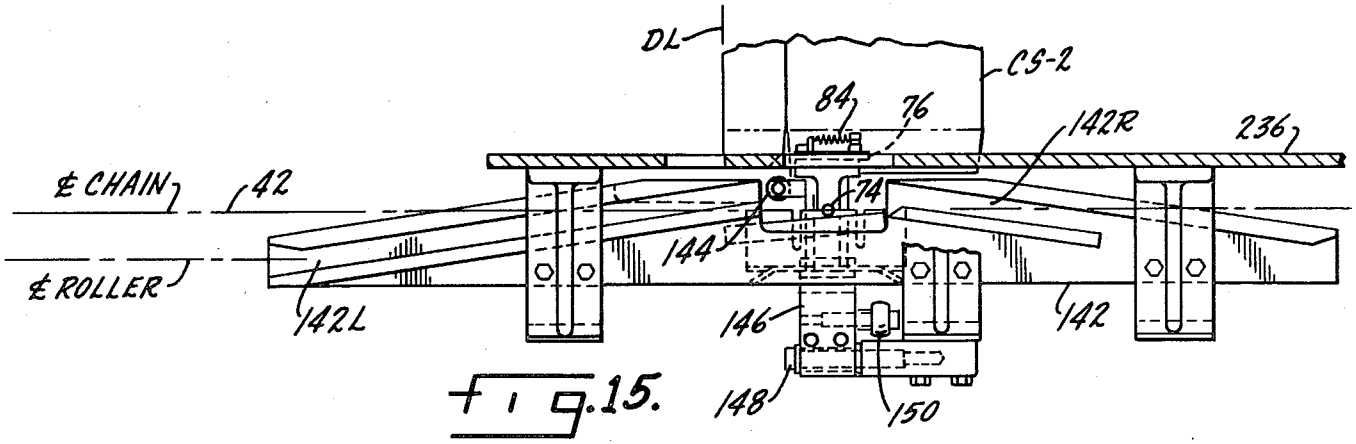
FIG. 15 is a detail plan view substantially on the line 15—15 of FIG. 14.

Referring now to FIG. 1 where attention had earlier been directed to the location of the latch finger opening roller 140, a cam track plate 142 is positioned beneath track 70 in which the base of the clamp rides in its inverted position during the lower pass or run of the chain 42. The cam track plate 142 is also shown in FIGS. 14 and 15, affording two cam tracks 142L and 142R. It may now be mentioned that the clamp head carries a cam track follower roller 144 on the top side of the movable clamp jaw as viewed in FIG. 8 but which is lowermost when the clamp is inverted as shown in FIGS. 12 and 13.

In FIG. 15 the center line of roller 144 is denoted and it will be observed that the center line of roller 144 is off-set in comparison to the center line of the chain 42. The base of the clamp is fastened to the chain and hence will follow the chain. On the other hand, when latch finger 76 is released the clamp head is free to turn and this occurs at the very time roller 144 enters the open left end of cam track 142L, FIG. 15. Therefore, as the chain continues its movement from left to right as viewed in FIG. 15 the clamp head is constrained to turn which pivots the carton shell from position CS-1, FIG. 10, to position CS-2 which is shown in both FIGS. 10 and 15.

When the shell attains position CS-2, which incidentally is the position at the pre-break station, the clamp is opened and this takes place at a stop position of the chain. Shortly thereafter intermittent motion of the chain is re-commenced and follower 144 enters the left, open end of cam track 142R. As the chain continues its travel from left to right, FIG. 15, the clamp head is returned to its original position by the camming force applied to the follower 144, and when the clamp head is realigned with the clamp back the latch finger catch 75 snaps into place once again to lock the clamp head to the clamp base.

Figure 16:
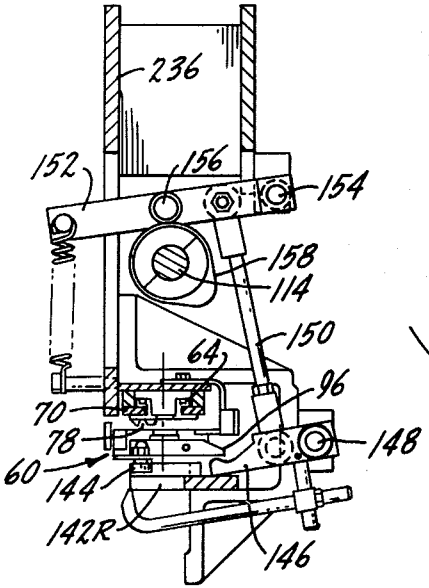
FIG. 16 is a detail sectional view showing the means to open the clamp to release the shell.

As noted above, another camming action is employed to open the clamp jaws when the carton shell is in position CS-2. The corresponding position of the clamp is shown in FIG. 16. The underside of one of the clamp jaw actuating fingers 96 is located above a jaw opening lever 146 mounted on a fixed pivot 148. This lever is to be pivoted upward or clockwise as viewed in FIG. 16 to exert an opening thrust against finger 96.

An operating rod 150 is attached at its lower end to the jaw opening lever 146 and the upper end of this rod is attached to a cam operated lever 152 which is pivoted at 154. Lever 152 carries a cam follower roller 156 opposed to a related cam 158 mounted on cam shaft 114. Lever 152 is biased by a return spring and when the lobe of the cam 158 is presented to the follower 156 the operating rod 150 is elevated to open the clamp. This releases the folded, glued shell and it drops into the pre-breaker cradle 36, FIG. 17, which afterwards squeezes the shell and erects it.

The clamp pulls the carton blank through the machine and does not push it. In this connection and referring to FIG. 8, the ribs 95R on the upper jaw lip apply an effective frictional force for clamping the leading edge of the carton blank, and after the carton blank is thus picked up it is afterwards pulled through the folding, gluing and compressing stations evident in FIG. 10 as the chain progresses along its upper path.

The chain is inverted about sprocket 46 and at the bottom of the sprocket means are effective to release the latch which normally holds the clamp head stationary to the clamp base. When the clamp head latch is released, the clamp head is free to turn to swing the carton shell in horizontal plane from position CS-1 to position CS-2, FIG. 10, and this is made possible by a follower on the clamp head which follows the cam track 142L while the clamp base continues to track along with the chain. After the carton shell has been turned through the predetermined angle the follower is in a free position, FIG. 15, between the right hand end of track 142L and the left hand end of track 142R. This also happens to be one of the intermittent positions of the clamp, meaning the clamp dwells in an idle position above the pre-breaker cradle 36, FIG. 17, for sufficient time to enable the actuator lever 146 to open the clamp jaws. Then, when the carton shell is released to the pre-breaker cradle shown in FIG. 17, at shell position CS-2, the chain is once more driven and the follower roller 144 is constrained by cam track 142R to return the clamp head to its latched position.

Eventually, the clamp in its lower path reaches sprocket 48, FIG. 1, returning the clamp in the direction of the upper sprocket 52 where the jaw opener lug 108 exerts a force on the movable clamp jaw to open the clamp to receive the next carton blank.

There may be a circumstance where a clamp is missing at the alloted space on the chain, purposely for some reason or because of repair. To prevent the suction cups from drawing down a carton blank under such a circumstance the valve (not shown) which communicates suction is controlled by a sensor switch finger 172, FIG. 1, in position to be actuated by a correctly positioned clamp moving therepast. If a clamp is missing (or incorrectly aligned) the sensor is not actuated and the valve is disabled from communicating vacuum for drawdown.

Of course the chain supports many clamps which is to say that as one jaw picks up a new carton blank at the supply magazine another jaw is being opened to deposit a glued shell in the pre-breaker station referred to in connection with FIG. 17.

Consideration will now be given to the construction of the supply magazine and the manner in which carton blanks are extracted therefrom.

THE SUPPLY MAGAZINE AND VACUUM DRAW-DOWN FOR THE CARTON BLANKS

Figure 6:
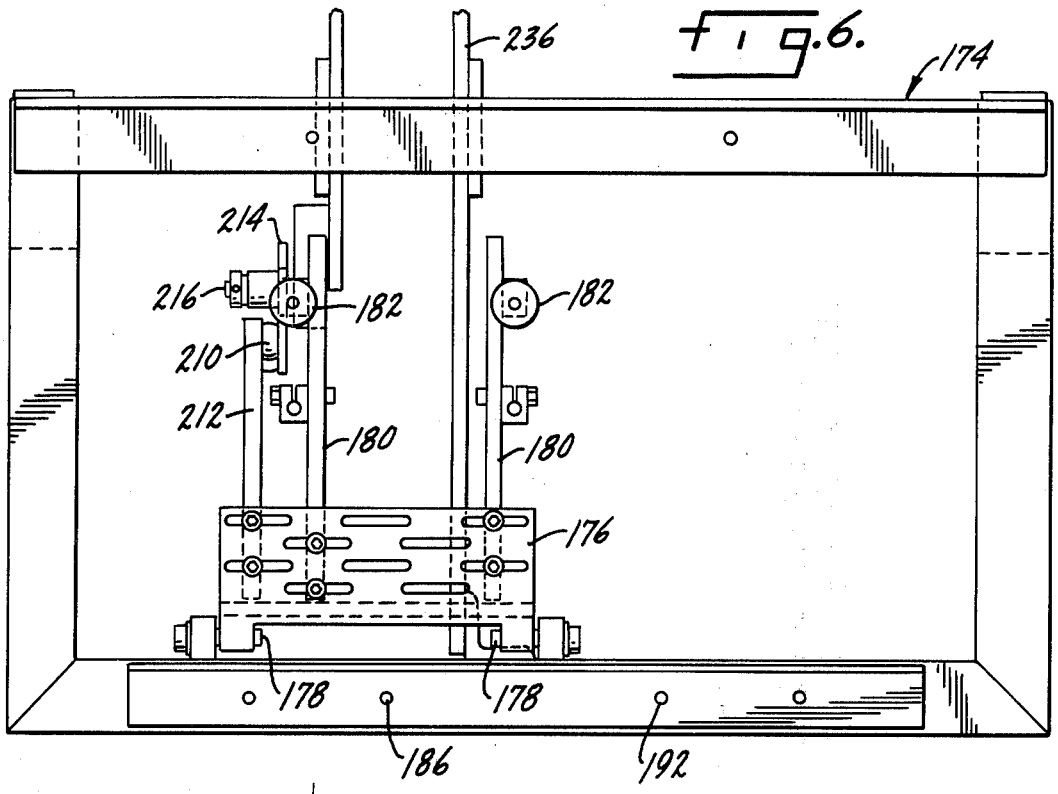
FIG. 6 is a plan view on the line 6—6 of FIG. 3.

The flat, unfolded carton blanks are stacked in the supply magazine, FIG. 1, at a 45° angle at one end of the machine. Features of the supply magazine are shown on a considerably larger scale in FIGS. 6 and 7. The supply magazine includes a large, open bottom supporting frame 174, FIGS. 6 and 7, and beneath the frame is a pivotally mounted draw-down plate 176, FIG. 3, journalled on pins 178 which are supported by the frame 174 at the rear edge thereof. A pair of support fingers 180, FIG. 6, are secured to plate 176 for lateral adjustment and these fingers support a pair of suction cups 182.

Figure 7:
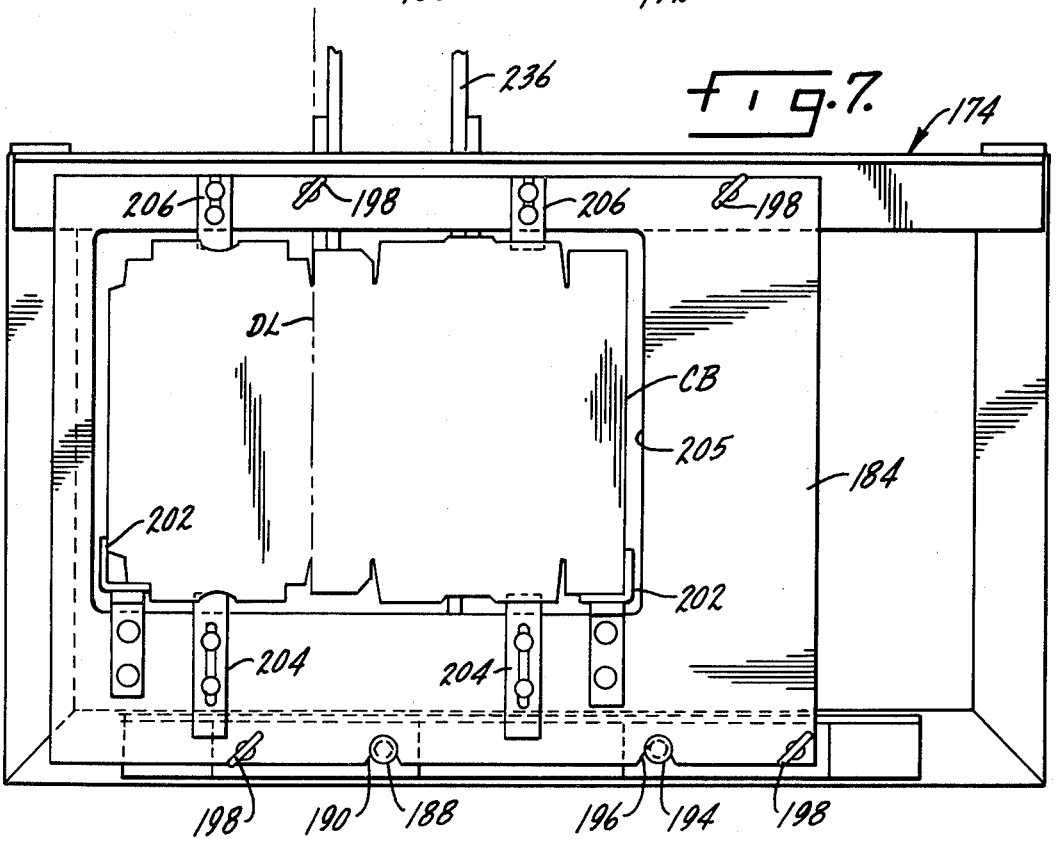
FIG. 7 is a view similar to FIG. 6, but showing superimposed parts.

In order that carton blanks of different dimension may be easily accomodated, a fixture frame is separably attached to the supporting frame 174, the fixture being specific to a carton blank of particular dimension and configuration. Thus as shown in FIG. 7, a rectangular plate 184 is positioned on the upper side of frame 174. Frame 174, FIG. 6, has an opening 186 for a registering dowel pin 188, FIG. 7, which is mated to a corresponding registering notch 190 in the fixture plate 184. The notch 190 accurately fits the dowel 188. The support frame 174 has a second opening 192 for positioning a second dowel 194 assigned to a larger, loose fit notch 196 in the fixture plate 184. Thus notch 190 is a close fit, registering notch while notch 196 assures parallelism. Wing nuts as 198 secure the fixture plate 184 to the frame 174.

The fixture plate 184 includes a pair of uprights 202, FIGS. 1 and 7, which are squared off neatly to fit corresponding square corners of the carton blank CB. The carton blank CB is a standard carbon blank of commercial form.

Additionally, the fixture plate 184 supports a pair of support blades or fingers 204 which have free ends extending into a rectangular opening 205 in the fixture plate 184, extending inward of the rear edge of the opening 205 just sufficiently to support the rear or trailing edge of the carton blank. The fingers 204 have elongated adjusting slots to enable the ends of the fingers 204 to support the trailing edge of the carton blank for the best extracting efficiency as will be explained below.

In like manner, a pair of support fingers 206 are adjustably supported at the opposite side of the opening 205, supporting the front or leading edge of the carton blank.

As mentioned above the support fixture 184 is specific to the carton blank CB. In the instance of the machine being supplied with carton blanks of another configuration or different dimension, there will be a similar fixture plate notched to fit the dowels 188 and 194 but this other fixture (not shown) may have its squaring uprights in a different position compared to the uprights 202. Also, the opening as 205 encompassing the carton blank may be of a different area and the support fingers may be oriented differently compared to those shown in FIG. 7. Thus, the support frame 174, equipped with two dowels 188 and 194 enables a different carton blank supporting fixture to be interchangeable in the machine.

Referring to FIG. 3, the draw-down support plate 176 which supports the suction cup fingers 180, as already noted, is supported for pivotal movement on pins as 178. To swing or oscillate the draw-down plate 176, an operating rod 210 (see FIG. 3) at its upper end is pivotally attached to an arm 212, FIG. 6, fastened to the plate 176.

Figure 5:
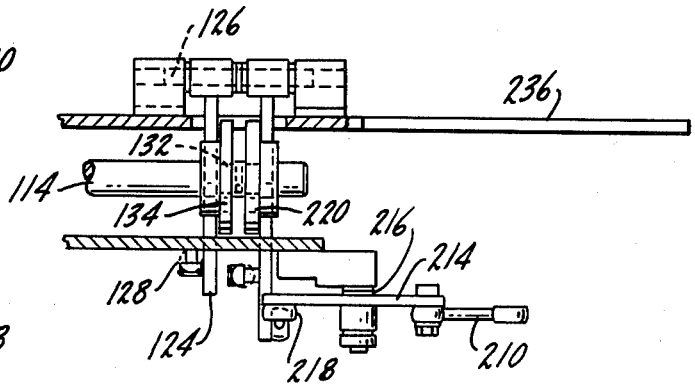
FIG. 5 is a fragmentary sectional view on the line 5—5 of FIG. 3.

Rod 210 at its opposite end is pivotally attached to a pin on a bell crank lever 214, FIG. 3. The bell crank is pivoted at 216, FIGS. 3 and 5, and the end of the bell crank opposite rod 210 is attached to an operating rod 218 which is oscillated by a cam 220 on cam shaft 114 in a manner similar to that described in FIG. 4 in connection with oscillation of the bell crank 116.

The lowermost carton blank within the opening as 205 of the carton blank fixture is extracted by suction (negative pressure) applied to the suction cups 182 at the time the latter are presented to the lowermost carton blank. The position of the pivot 178 for the draw-down plate 180 is so located that as it is swung counter-clockwise, FIG. 3, to extract the lowermost carton blank the rear edge of the carton blank slides off the rear support fingers 204 with a forward motion component. Thus, by tilting the supply magazine in the first place a great deal of the weight of the stack is represented by a rearward thrust against the support bars 202, FIG. 7, and since the carton blank is in effect fixed to the suction cups 182 the carton blank has to move forward off the rear fingers with a sliding motion as the suction cups move on their arc.

Referring to FIG. 8, the leading edge of the carton blank CB was just a moment before, moved into the maw of the open jaws as an incident to completion of vacuum draw-down motion. The next instant, the jaws are allowed to close by a corresponding counter-clockwise movement of the bell crank 116, FIG. 3, vacuum is released and the chain is indexed in the direction of the first folding station.

FOLDING AND GLUING

The flat carton blank extracted from the supply magazine, FIG. 9, has a pair of panels A and B separated by a pair of score lines L-1 and L-2. The carton blank at one side includes a glue flap C and at the opposite side includes a second glue flap D. The opposed ends of the carton are provided with end closure flaps.

In folding the carton blank to form or construct the shell, panel A is folded upwardly along score line L-1 and then is folded downwardly in the same direction to be juxtaposed on panel B; panel C is folded upwardly along a score line L-3 and then is folded over to meet panel D. Thus, two ninety degree folds are made at score line L-1 and two ninety degree folds are made at score line L-3 resulting in the flue glaps being presented to one another. At the same time, score lines L-1 and L-3 are effectively broken. Subsequently in the pre-break station, FIG. 17, the two remaining score lines L-2 and L-4 are broken.

The progression is shown in FIG. 10. The flat blank is shown in the extended (no fold) condition as it was extracted from the supply magazine.

In the next position to the left, a folder blade 225 is effective to bend panel A upwards. In the next position, another folder blade 225A is effective to bend panel A downwards to meet panel B and concurrently a folder blade 226 is effective to erect glue flap C to upright position. In the next position, another folder blade 227 is effective to bend glue flap C over to meet glue flap D and pressure is concurrently applied by a cooperating anvil (not shown) beneath folder blade 227 to force the glue flaps into intimate contact to insure a tight shell CS which is afterwards inverted about sprocket 46.

Thus, considering the center line of the chain 42, FIG. 10, the carton blank is folded twice on the near side to present panel A to panel B and is folded twice on the opposite side to complete the side seam. The last fold, incidental to completing the side seam, also compresses the glue seam.

The folder blades, though they may differ in the position occupied when unactuated, are operated in a similar manner and consequently the operation now to be described for folder blade 226 applies equally well to the others.

Referring to FIG. 11, folder blade 226 is pivotally mounted on a support 228 in turn attached to an adjusting plate 230 which, as shown in FIG. 10, extends the length of the folding and gluing stations.

The ends of the adjusting plate 230 are free to slide on a pair of end supports of which one is identified by reference character 232 in FIG. 11. The end supports in turn are welded to a pair of angles at 234 rigidly attached to upright mounting plate 236.

Folder blade 226 is actuated by a connecting rod 238 operated by lever 239 having a cam follower 242 opposed to a cam 244.

The spring bias for the operating lever 239 is evident in FIG. 11 and the operation to raise and lower folding blade as 226 will be evident from what has been described above in connection with the other devices operated from a cam on shaft 114.

The folder blade 227 which completes the compression fold on the far side of chain 42, FIG. 10, is also supported on the adjusting plate 230. By mounting these two folder blades on the adjusting plate 230, the latter can be moved back and forth to accomodate cartons of different size. As shown in FIG. 10 a pair of linear scales 240 are associated with the end supports 232. The plate 230 has indices for accurate positioning. Consequently, the adjusting plate can be moved closer to or farther from the center line of chain 42, which, incidentally, represents an invariant datum position in the machine. The plate 230 is locked in an adjusted position by screws (not shown) fitting a slot 241 in plate 230 and extending to support 232.

If a change in the lateral position of adjusting plate 230 is small it is not necessary to alter the connecting rod 238 because precision in the angle fold is not essential. It is enough to approximately bend the carton panel or glue flap, as the case may be, approximately through ninety degrees. However, if the adjusting movement is large it may be necessary to substitute a different connecting rod, FIG. 11. The point is that by supporting a pair of folder blades and an associated bender bar on an adjustable plate on one side of the chain 42, those two folder blades can be employed at the two folding stations to fold a corresponding panel or flap through the required 180 degree bend.

Folder blade 225 is on the near side of chain 42 together with the related folder blade 225A employed at the next downstream position to make the required 180 degree bend in panel A. To make the first ninety degree or upward fold, folder blade 225 would be raised from a horizontal position to the dashed line position shown in FIG. 10. The folder blades on the near side, FIG. 10, cooperate with a bender bar to complete the necessary folds.

An elongated bender bar or rail 245, FIG. 11, serves as an anvil in cooperation with folder blades 226 and 227 to complete the folds on the far side of the chain as viewed in FIG. 10, and a like bender bar or rail 246 cooperates with the folder blades or plates 225 and 225A on the near side.

The anvils 245 and 246 depend from a support head 247, pivoted at 248 so it may be raised and lowered. Rail 245 is slideably attached to the support head 247 so it may be shifted accordingly as support plate 230 may be shifted.

The carton blank is of course positioned immediately beneath the bender bars and rides on a pair of lower rails 245A and 246A, FIG. 11.

Figure 20:
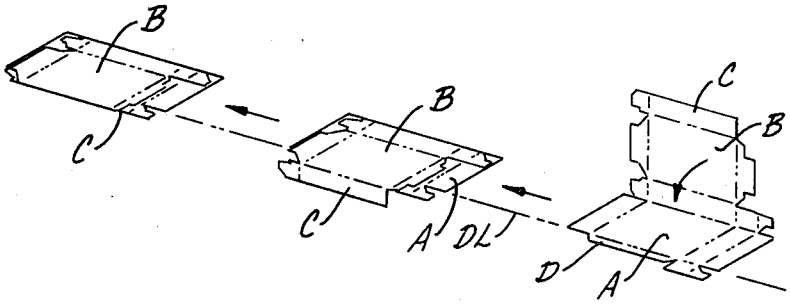
FIG. 20 shows a different folding possibility compared to FIG. 10.

The bender bar associated with the folder blades on the near side of the chain, FIG. 10, represents a significant datum line DL, FIG. 9, which happens to be coincident with the score line L-1. This datum line, in nearly all instances, will be invariant regardless of carton size because it represents the orienting datum line which, at the bottom of the chain run, FIG. 10, will be turned ninety degrees in the horizontal plane to be aligned with a corresponding datum line position in the supply magazine of the cartoner. In this connection, and in order further to explain the flexibility of the machine, it can be imagined in FIG. 10, that the carton blank CB is reoriented so that score line L-4 becomes the datum line DL. This is shown in FIG. 20. In that event, the adjustment plate 230 would be moved in the direction of the upper right hand corner of the drawing sheet (FIG. 10) a considerable distance. The folding sequence might then be to fold panel B upward then down along score line L-1, FIG. 9, while folding glue flap C downwards instead of upwards, FIG. 20. The gluing nozzle 34 would be at the under side of the carton, applying glue to the under side of glue flap D after which glue flap C would be bent upwards during the final compression fold so that the side seam is at the under side of the shell instead of on the top side.

From this example the importance of the changeable fixture at the supply magazine can also be realized because, since the path of the chain is invariant, it becomes advantageous to be able to locate the carton blanks in the magazine so that the clamping jaws capture the carton with the datum line (e.g. datum line DL, FIG. 9) in the proper position for folding. Thus, in the example mentioned above where score line L-4 becomes the datum line, the clamping jaws would be clamping the carton blank near the center line of panel A and that means a corresponding fixture plate specific to the new orientation of a carton would be moved considerably to the right, as viewed in FIG. 7, compared to the fixture shown in FIG. 7.

THE PRE-BREAKER AND DELIVERY TO THE MAGAZINE OF THE CARTONER

In the course of folding, two of the score lines L-1 and L-3 are broken but there are two score lines L-2 and L-4 not broken. These remaining score lines are broken at the station shown in FIG. 17 as an incident to pivoting the arms 38 and 40 inwardly toward one another. As shown in FIG. 18, the arms 38 and 40 are of elongated nature and they are supported for pivotal movement on long pins 250 and 252. At the free end of each arm 38 and 40 there is an angle bar 254 and 256 respectively. The glued shell CS-2 is supported directly by angle bar 254 but angle bar 256 is equipped with a pair of capturing fingers 258 to assure that the shell released by the clamp is indeed intercepted. The arms 38 and 40 normally extend upwardly at about a 45° angle.

The erecting cradle represented by the arms 254 and 256 is another device which is cam operated. Referring again to FIG. 18, arm 40 is provided with a slot 260. The lower end of an operating rod 262 extends downward through slot 260 and is pivotally coupled to arm 40 so that a downward force applied to rod 262 results in counter-clockwise movement of arm 40 as viewed in FIG. 17. As will be explained in detail below, arm 38 is linked to arm 40 so that the two arms representing the erecting cradle are operated concurrently.

As shown in FIG. 17, link 264 is secured to the underside of arm 40 and projects downwardly. A lug 266 is attached to link 264 and projects upwardly. The lower end of operating rod 262 is pivotally connected to lug 266 and the upper end of rod 262 is pivotally attached to a pin on a cam operated lever 268 which is biased by a return spring 270 to present a cam follower 272 to a corresponding cam 274 on the cam shaft.

Thus the cam 274 and return spring 270 cooperate to impart reciprocal motion to the operating rod 262.

To drive arm 38 concurrently with arm 40, a long link rod 276 is pivotally mounted at one end to the lower end of link 264 and the opposite end is pivotally attached to an arm 278 in turn fixed to erector 38.

Rod 262, like all other cam operated rods in the machine, is lengthwise adjustable in either direction by having threads fitting a sleeve 280, the latter being pivotally attached to the operating lever 268. Hence, by turning rod 262 in sleeve 280 it is possible either to shorten or lengthen lever 262 so that ther can be a fine adjustment for the length of the operating stroke imparted to the pre-breaker arms 38 and 40.

It will also be noted in FIG. 19 that the cam operated lever arm 268 is provided with a series of openings 282 representing selective positions for pivotally connecting sleeve 280 to the lever 268 and this selective attachment enables large adjustments in the stroke of rod 262 to be easily accomplished.

The adjustments just mentioned are made to assure that when arms 38 and 40 are separated by the least distance in the course of breaking the carton, the carton has indeed been erected to a square position and then the arms 38 and 40 continue downward to in effect deliver the broken shell to the supply magazine of the cartoner, FIG. 21.

To assure the broken shell escapes from the pre-breaker station, an arm 284, FIG. 17, is fastened to breaker arm 40 and in the course of the downward sweep is effective to push the shell into the cartoner magazine. In some instances it may be advantageous to substitute an air operated (cylinder actuated) foot (not shown) as a substitute for the pusher arm 284.

A pair of spring-biased stop blades 286 and 288, FIGS. 18 and 19, are engaged and urged apart by the carton as it is delivered downward from the pre-breaker station. These stops represent a one-way gate, preventing the carton shell last delivered from interfering with the next delivery to the magazine of the cartoner.

The datum line DL shown in FIGS. 17 and 18 has been carried forward to FIG. 21. It is co-lineal with a corresponding datum line of the cartoner magazine.

A carton erected by the pre-breaker is shown in dashed line at EC, FIG. 21, and a broken carton beneath is shown being pushed into the cartoner magazine. There is a stop finger 292 at the bottom of the cartoner magazine where a pair of vacuum drawdown cups 294 are effective to extract the bottom-most carton and pull it downward against a cam surface 296 which erects the carton for filling. The direction of carton flow is shown in FIG. 21 and this path is parallel to the folding path where the carton blank is folded.

The folder-gluer is preferably driven at a greater rate than the rate of sending cartons through the cartoner, meaning that the cartoner magazine can be over-supplied. To prevent this, a sensor switch 300, FIG. 19, has its switch actuator finger in position to detect back pressure on one of the stop plates at the pre-breaker escape route. Thus, when the pusher 284 is no longer able to compact the shells fed to the cartoner magazine, the inherent springiness of the stack of carton shells in the cartoner magazine presses back against the stop plate as 286, FIG. 19, actuating sensor 300 which disrupts vacuum at the drawdown magazine 32, FIG. 1, just as the sensor 172, FIG. 1, is employed for the same purpose when a clamp on the chain fails to trip the sensor 172.

SUMMARY

The machine, FIG. 1, forms the carton from a flat blank into a side seam glued shell and loads the shell into the magazine of a standard cartoning machine, FIG. 21. The glued cartons are presented to the cartoner by the folder-gluer, on an on-demand basis. The speed of the side seam gluer is slightly faster than the cartoner and when the cartoner magazine is full, the folder-gluer stops forming cartons until the magazine supply at the cartoner is depleted.

The advantages of the present machine over existing equipment are as follows:

1. It mounts directly to, and becomes a part of the cartoning machine. This is an advantage because an additional operator is not required and the cartons are formed just prior to use which avoids spoilage. Spoilage can occur as a result of prolonged storage which causes the scored and broken corners to become too stiff for proper drawdown into the cartoner.

2. Savings in warehouse storage space: flat blank cartons for loading the magazine 32, FIG. 1, use less than half the space of glued shells.

3. The cost of constant rotation of carton inventory on a first-in, first-out basis to avoid spoilage is avoided.

4. The savings as a result of larger quantity purchasing because storage of the flat blanks can be extended beyond ninety days.

The magazine provides means for holding approximately a 15" high stack of flat blanks at a 45° angle. These blanks are positioned in such a way that they will be correctly aligned above the chain flight system. the vacuum cup drawdown plate 176 (FIG. 3) swings upward as viewed in FIG. 1 and accurately removes one flat blank carton from the bottom of the stack. The pivot for this drawdown is so arranged that the forward edge of the carton is pulled downward out of the stack and positioned within the jaws of the clamp, while the rear edge is slid forward thus separating the carton from the bottom of the stack. The jaws of the clamp close, locking the carton to the chain flight system. At this time the vacuum to cups 182 is valved off, thus freeing the carton from the vacuum cups.

The chain flight system then advances one index (14" as an example) which moves the carton into the first fold position.

The machine is provided with three fold positions: the first two are used to fold the carton over onto itself. The glue is applied on the index movement between the second and third fold positions. The third fold position is used to complete the last fold and apply pressure to seal the glue joint.

The fold elements are mounted on plates in front of and behind the chain flights. The front plate is fixed in place and maintains the length datum (DL) of the carton in the correct position for depositing into the cartoning machine. The position of the rear folder can be adjusted to accomodate carton size changes. A set of graduated scales is provided at both ends of the rear plate for accuracy in carton size adjustment.

After the carton has been folded over onto itself and the side seam has been glued, the glued shell is transported around a vertical sprocket. At the bottom of the sprocket the latch mechanism of the carton clamp is released and the carton is rotated 90° for correct orientation into the cartoning machine. The 90° rotation of the carton is obtained by a roller on the carton clamp head engaging a fixed track as the chain indexes forward in the direction of carton blank supply magazine.

The rotated carton is ejected from the clamp into the pre-break (carton erection) position, the prebreak breaks the remaining two score lines on the carton shell and at the same time deposits the erected carton into the cartoning machine magazine.

The pre-break station consists of two levers, the pivots of which are positioned so that as the levers are cammed downward the outer ends, which are holding the carton, swing inward forcing the carton to erect into a box-like shape. The levers then continue downward pushing the carton thru a pair of guarding plates 286 and 288 and into the cartoner magazine. These plates act to trap the carton, preventing it from springing back up, out of the magazine. When a large quantity of cartons have been inserted into the cartoner magazine, FIG. 21, the back pressure against the plates increases, which trips a switch stopping the vacuum drawdown. As cartons are removed from the magazine the back pressure is reduced which causes the vacuum drawdown to resume.

We claim:

1. In a machine for folding carton blanks along score lines, gluing down a glue flap on the carton, and delivering the glued carton to the supply magazine of a cartoner machine where the carton is erected and then filled by moving the erected carton along a filling path:

means to clamp and pull each carton blank progressively through folding and gluing stations along a folding axis parallel to but spaced from the filling path of the cartoner machine with said one score line also being parallel to said filling path as the blank is being moved through said folding and gluing stations;

means at said stations respectively to fold the blank and glue said glue flap to an opposed surface of the blank;

means to invert the blank after it is glued and while it is still clamped;

and means to deliver the inverted blank to the supply magazine of the cartoner machine.

2. A machine according to claim 1 in which the means to fold the blank comprises an elongated barlike anvil extended parallel to said filling path and cooperating folder blades opposed thereto for bending panels of the carton blank against said anvil.

3. A machine according to claim 1 having means at said delivery station to cradle the glued blank, to break the glued blank along score lines, and to deliver the broken blank directly to the supply magazine of the cartoner.

4. A machine according to claim 1 having a supply magazine for the blanks to be folded and said magazine including rear support fingers on which the supply of blanks is stacked, pivotally mounted vacuum draw-down means to extract the lowermost blank in the supply stack, and the pivot for said draw-down means being so placed that the lowermost blank in the supply is pulled forwardly off the rear support fingers with a forward motion component.

5. A machine according to claim 1 having spaced spring-closed clamps attached to an endless chain for clamping a leading edge of the carton blanks and pulling them through the folding and gluing stations, a sprocket downstream of the gluing station for inverting the chain to invert the glued blank, a sprocket adjacent the carton blank supply magazine for re-inverting the chain, means adjacent said carton blank supply station for opening each clamp to grab an extracted blank, and means to open the clamp to release the glued blank.

6. A machine according to claim 2 in which the means to fold the blank comprises:

a pair of folder blades and a cooperating anvil on one side of said folding axis for making successive 90° bends about one score line of the carton;

a pair of folder blades and cooperating anvil on the other side of said folding axis for making successive 90° bends about a second score line of the carton;

and said first pair of folder blades and cooperating anvil being supported for adjustment toward and away from said axis.

7. A machine according to claim 6 including means positioned between the folder blades of the second pair to apply glue to the carton before the last of the 90° bends is made.

8. In a carton folding machine where a carton blank having a glue flap is folded on two score lines progressively into flat shell form after which the glue flap is adhered to an opposed outside carton surface to afford a shell which is to be pre-broken along two additional score lines to render final erection easier in a cartoner machine, and wherein one of the fold lines is also an orienting datum line:

means for transporting the blank along a predetermined feed axis through progressive folding and gluing stations without altering the orientation of the datum line;

means for inverting the glued shell;

means for turning the inverted shell through a 90° angle in a horizontal plane and for depositing the shell in a pre-breaker cradle at a pre-breaker station with said datum line reoriented by the same angle; and a pre-breaker cradle at the pre-breaker station for erecting the carton and for delivering the carton out of the pre-breaker station without altering the angular orientation of said datum line.

9. A carton folding machine according to claim 8 juxtaposed to the carton blank supply magazine of a cartoner machine in which the carton is to be filled, and in which said pre-breaker station and the carton blank supply magazine are paralleled to said datum line so the broken carton in the pre-breaker station may be delivered directly from the pre-breaker station to said carton blank supply magazine.

10. A carton folding machine according to claim 9 in which the pre-breaker cradle includes a pair of pivotally supported upwardly inclined arms presenting stops for capturing opposed side edges of the glued shell, and means for pivoting the arms downwardly along arcs which approach one another and then depart from one another first to bend the carton to erect position and then to deliver the broken carton from the pre-breaker station.

11. A carton folding machine according to claim 9 in which the transporting means includes a clamp pivotally mounted on an endless conveyor, guide means for pivoting the clamp through said 90° angle, and means to open the clamp to drop the glued shell in the prebreaker cradle.

12. A carton folding machine according to claim 9 having a sensor in position to detect the level of cartons in the cartoner supply magazine.

13. A carton folding machine according to claim 10 juxtaposed to the carton blank supply magazine of a cartoner machine and in which said arms of said cradle deliver the broken carton directly to said carton blank supply magazine.

14. In a machine for folding carton blanks along score lines, gluing down a glue flap on the carton, and delivering the glued carton to the supply magazine of a cartoner machine where the carton is first erected and then filled by moving the erected carton along a filling path, and wherein the carton has one score line denoting a datum line having an orientation in said supply magazine at right angles to said filling path:

means to clamp and pull each carton blank progressively through folding and gluing stations along an axis parallel to but spaced from the filling path of the cartoner machine with said one score line also being parallel to said filling path as the blank is being moved through said folding and gluing stations;

means at said stations respectively to fold the blank and glue said glue flap to an opposed surface of the blank;

means to invert the blank after it is glued and while it is still clamped;

means to turn the glued blank in a horizontal plane after it is inverted and to advance the turned blank to a delivery station with said one fold line oriented parallel to and substantially coincident with said datum line in the cartoner supply magazine;

and means to deliver the so-oriented blank to the supply magazine of the cartoner machine.

15. A machine according to claim 14 having a supply magazine for the blanks to be folded and said magazine including rear support fingers on which the supply of blanks is stacked, pivotally mounted vacuum draw-down means to extract the lowermost blank in the supply stack, and the pivot for said draw-down means being so placed that the lowermost blank in the supply is pulled forwardly off the rear support fingers with a forward motion component.

16. A machine according to claim 15 in which the means to fold the blank comprises an elongated barlike anvil extended parallel to said filling path and cooperating folder blades opposed thereto for bending panels of the carton blank against said anvil.

17. A machine according to claim 15 having means at said delivery station to cradle the glued blank, to break the glued blank along score lines, and to deliver the broken blank directly to said supply magazine with said one fold line square to said datum line.

18. A machine according to claim 17 having spaced spring-closed clamps attached to an endless chain for clamping a leading edge of the carton blanks and pulling them through the folding and gluing stations, a sprocket downstream of the gluing station for inverting the chain to invert the glued blank, a sprocket adjacent the carton blank supply magazine for re-inverting the chain, means adjacent said carton blank supply station for opening each clamp to grab an extracted blank, and means adjacent the delivery station to open the clamp to release the glued blank.

19. A machine according to claim 18 having spaced spring-closed clamps attached to an endless chain for clamping a leading edge of the carton blanks and pulling them through the folding and gluing stations, a sprocket downstream of the gluing station for inverting the chain to invert the glued blank, a sprocket adjacent the carton blank supply magazine for re-inverting the chain, means adjacent said carton blank supply station for opening each clamp to grab an extracted blank, and means adjacent the delivery station to open the clamp to release the glued blank.

* * * * *